US007520082B2

(12) United States Patent
An

(10) Patent No.: US 7,520,082 B2
(45) Date of Patent: Apr. 21, 2009

(54) AUTOMATIC CLEANING APPARATUS FOR GUN BARREL

(75) Inventor: Sang Jin An, Ulsan (KR)

(73) Assignee: Soosung Machinery Co., Ltd., Buk-Gu, Ulsan (KR)

( * ) Notice: Subject to any disclaimer, the term of this patent is extended or adjusted under 35 U.S.C. 154(b) by 202 days.

(21) Appl. No.: 11/509,547

(22) Filed: Aug. 24, 2006

(65) Prior Publication Data

US 2007/0240353 A1 Oct. 18, 2007

(30) Foreign Application Priority Data

Apr. 12, 2006 (KR) ..... 10-2006-0033030

(51) Int. Cl.
*F41A 31/02* (2006.01)
*B08B 9/047* (2006.01)

(52) U.S. Cl. ..... 42/95; 15/104.05; 15/104.09

(58) Field of Classification Search ..... 42/95; 15/104.05–104.33
See application file for complete search history.

(56) References Cited

U.S. PATENT DOCUMENTS 3,037,228 A 6/1962 Cummings
3,134,202 A * 5/1964 Hoefler ..... 451/211
4,290,163 A 9/1981 Opitz et al.
4,369,071 A * 1/1983 Flach et al. ..... 134/8
4,468,834 A * 9/1984 David ..... 15/246
4,600,444 A * 7/1986 Miner ..... 134/8
4,726,137 A * 2/1988 Zurek et al. ..... 42/95
5,099,537 A * 3/1992 Denny ..... 15/88
5,233,791 A * 8/1993 McQueen, Jr. ..... 451/481
5,460,563 A * 10/1995 McQueen, Jr. ..... 451/57
7,073,286 B2 * 7/2006 Paananen et al. ..... 42/95
2007/0240561 A1 * 10/2007 An ..... 89/1.4

FOREIGN PATENT DOCUMENTS

KR 2002 0034129 5/2002
KR 100 610183 8/2006

* cited by examiner

*Primary Examiner*—Bret Hayes
*Assistant Examiner*—Michael D David
(74) *Attorney, Agent, or Firm*—Ladas & Parry LLP

(57) ABSTRACT

An automatic cleaning apparatus for a gun barrel, which includes a wheel contacting an inner surface of the gun barrel and a brush or non-woven fabric rotating against the inner surface of the gun barrel which is applied with a cleaning solution or anti-corrosive oil, and moves forward by rotation of the wheel.

10 Claims, 3 Drawing Sheets

AUTOMATIC CLEANING APPARATUS FOR GUN BARREL

CROSS-REFERENCE TO RELATED APPLICATION

This application is based on and claims priority from Korean Patent Application No. 10-2006-0033030, filed on Apr. 12, 2006 in the Korean Intellectual Property Office, the disclosure of which is incorporated herein in its entirety by reference.

BACKGROUND OF THE INVENTION

1. Field of the Invention

The present invention relates to an apparatus for cleaning a gun barrel of various self-propelled artilleries which are long-range firepower, and more particularly, to an automatic cleaning apparatus for a gun barrel, in which a brush comes in contact with an inner surface of the barrel to remove an alien substance while the brush moves inside the barrel.

2. Description of the Prior Art

In various self-propelled artilleries and towed howitzers, it is important for gun crews to have skilled and trained marksmanship. In particular, the maintenance of such expensive equipments is very important. The self-propelled artilleries and towed howitzers are limited to disassembly and lubrication whenever they are repaired and maintained, as compared with common rifles such as individual carrying firearms.

In particular, the cleaning and washing of the gun barrel takes a lot of hard work. A fabric is wound around one end of a long barrel cleaning rod, and the repetitive pushing/pulling operation of the barrel cleaning rod into/from the gun barrel removes rust from the gun barrel or alien substances remained on the gun barrel after firing.

The above cleaning process is hardly performed by several crews. Also, since a lot of time is consumed to perform the cleaning operation, many drawbacks happen in time of wars which requires quick cleaning.

In order to solve the above problems, a new automatic cleaning apparatus for a gun barrel has been proposed by the applicant (see Korean Patent No. 10-0377487), a cross-sectional view of which is shown in FIG. 1.

Referring to FIG. 1, the conventional automatic cleaning apparatus for the gun barrel includes a drive unit 20 having a plurality of drive wheels 22 and 22-1 to generate a driving force, the drive wheels being spaced on the outer surface of a cylindrical case 10 and cooperated with drive motors 20*a* and 20*b* provided in front and rear inner parts of the case, a cleaning unit 30 interposed between the two drive motors 20*a* and 20*b* and having a frictional member coupled to a connector linearly moved by the rotational force of the front drive motor 20*a*, the frictional member being repeatedly linearly moved on the outer surface of the case to remove an alien substance from the inner surface of the gun barrel, and a spray unit 40 for dispensing a cleaning solution, which is stored in a cleaning container, in fine grains from the front part of the frictional member by continuous movement of a piston cooperated with the connector.

As can be seen from Korean Patent No. 10-0377487, reference numeral 30 denotes a cleaning unit, 21 denotes a front shaft, 21-1 denotes a rear shaft, 21*a*denotes a worm gear, 21*b* denotes a first bevel gear, 11 denotes a battery, 34*a*denotes a second bevel gear, and 50 denotes a non-woven fabric layer, respectively.

According to the conventional apparatus, the spray unit is cooperated with the reciprocating motion of the piston to suck in the cleaning solution and dispense it. The linear motion of the piston is associated with the cleaning unit. Therefore, the interconnection structure of the units is very complex, which causes frequent failures.

In addition, plural check valves are required to pump the cleaning solution out of the cleaning container, so that the construction is complicated. Also, since the cleaning unit is connected to the spray unit, if a problem happens in any one of the connections, a problem may happen in another connection, which causes a serious failure over the whole equipment.

SUMMARY OF THE INVENTION

Accordingly, the present invention has been made to solve the above-mentioned problems occurring in the prior art while advantages achieved by the prior art are maintained intact.

One object of the present invention is to provide an automatic cleaning apparatus for a gun barrel which can improve its operability by preventing failure of components.

Another object of the present invention is to provide an automatic cleaning apparatus for a gun barrel which can selectively dispense a cleaning solution or anti-corrosive oil by using an independent pump and can operate a brush by using a planetary gear system so as not to apply an excessive load to motor drive.

Still another object of the present invention is to provide an automatic cleaning apparatus for a gun barrel which can prevent application of overload to any one motor by coupling two motors.

Still another object of the present invention is to provide an automatic cleaning apparatus for a gun barrel which can clean the gun barrel simply by using a planetary gear system as compared with a conventional complicated driving system.

In order to accomplish these objects, there is provided an automatic cleaning apparatus for a gun barrel including a wheel contacting an inner surface of the gun barrel and a brush or non-woven fabric rotating against the inner surface of the gun barrel which is applied with a cleaning solution or anti-corrosive oil, and moving forward by rotation of the wheel, which includes a gear housing interposed between a front wheel and a rear wheel which are rotated in cooperation with a motor, and having a penetrated axial center part, a main shaft installed in the center part of the gear housing, and coupled to the motor and rotated by the motor, a sun gear disposed in a direction perpendicular to an axial direction of the gear housing, and coupled to the main shaft, a plurality of planetary gears positioned in a through-hole formed on the gear housing, restrained by a fastening bolt to mesh with the sun gear to rotate on its axis, and an external gear meshed with outer surfaces of the planetary gears, the brush or non-woven fabric being detachably engaged to the external gear.

In one embodiment, the automatic cleaning apparatus may include an oil container filled with the cleaning solution or anti-corrosive oil, in which an oil pump is provided on an inside or outside of the oil container. Also, the automatic cleaning apparatus may include a plurality of sensors for detecting the wheel to be out of a muzzle of the gun barrel.

The motors are arranged in opposite to each other, and are coupled to the main shaft to transfer forces generated from the two motors to the main shaft.

The brush or non-woven fabric is inserted into a connector coupled to the external gear, and the connector has a spring under a lower surface of the connector inserted into the external gear, and a guide groove is formed on one side of the connector. The non-woven fabric is additionally engaged to left and right sides of the brush.

Also, the housing may have a spray orifice for dispensing the cleaning solution or anti-corrosive oil onto the inner surface of the gun barrel. The oil container may be detachably coupled to the housing equipped with the motor.

The automatic cleaning apparatus may further include a control panel to change conditions such as selection of the cleaning solution or anti-corrosive oil to be dispensed, a dispensing amount, a rolling speed of the wheel, or the like. The oil pump is constructed to pump either of the cleaning solution and the anti-corrosive oil by using a solenoid valve.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, a preferred embodiment of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

The construction of an automatic cleaning apparatus for a gun barrel according to the present invention will now be described in detail with reference to preferred embodiment.

The gist of the present invention adopts a planetary gear system so as to perform cleaning of the gun barrel with a brush, and also adopts a unique coupling structure for the planetary gear system.

The automatic cleaning apparatus for gun barrel according to the present invention includes a plurality of wheels of a circular shape like the gun barrel, the outer surface of the wheel coming in contact with the inner surface of the gun barrel. The automatic cleaning apparatus can move forward along the inner surface of the gun barrel while the wheels are rotated. At that time, a brush or non-woven fabric is rotated to clean the gun barrel or resist rust, while a cleaning solution or anti-corrosive oil is dispensed onto the inner surface of the gun barrel.

Although described hereinafter, the brush or non-woven fabric is engaged to an external gear as an insert mode so that it can be easily attached to or detached from the external gear. When cleaning, the brush is generally used, but the brush and the non-woven fabric can be used at the same time. When the anti-corrosive oil is dispensed for the purpose of resisting rust, the brush is detached from the external gear, and the non-woven fabric is attached to the external gear.

Figure 1:
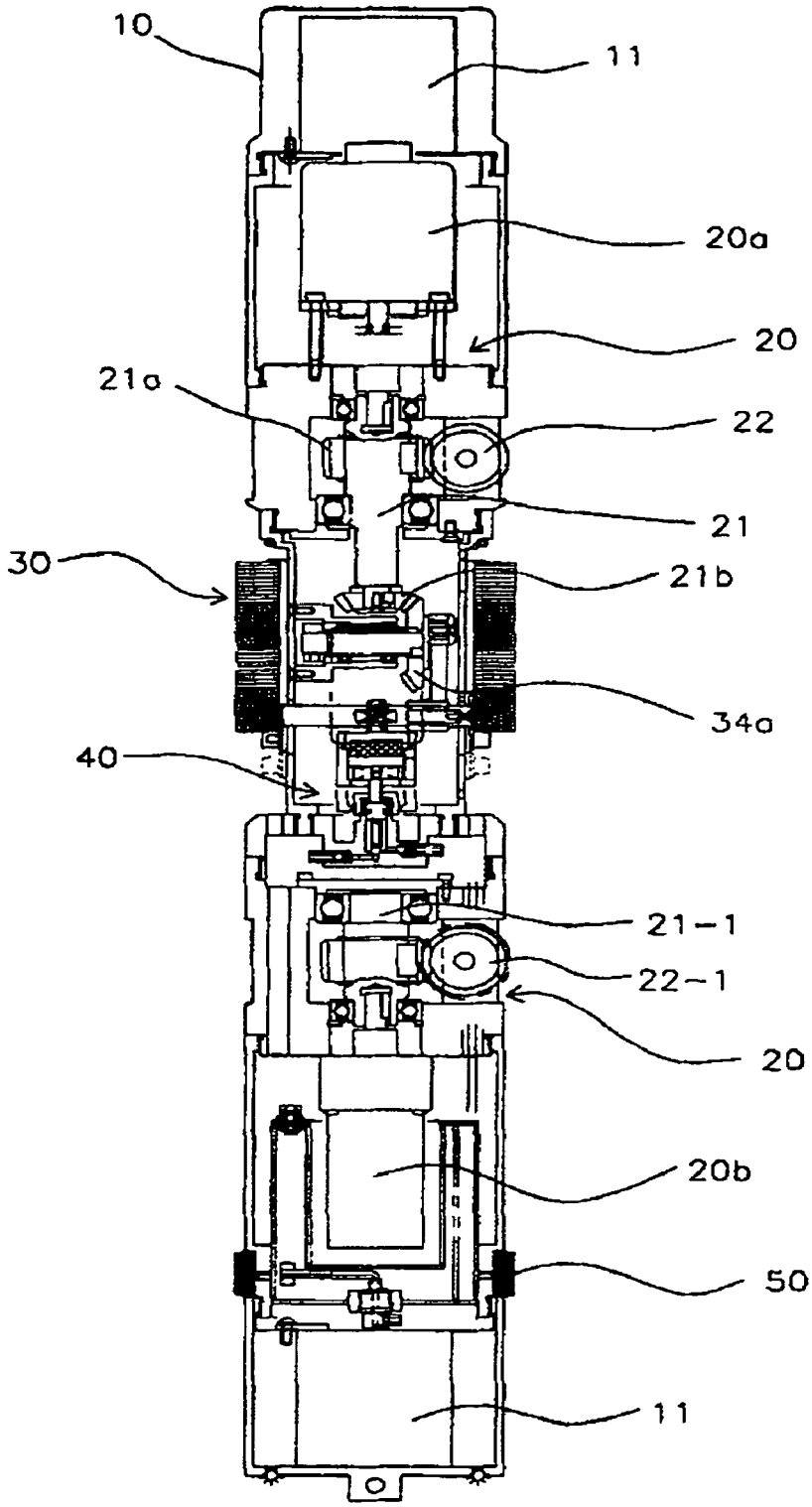
Fig. 1 Prior Art
FIG. 1 is a cross-sectional view of a conventional automatic cleaning apparatus for a gun barrel.
Figure 2:
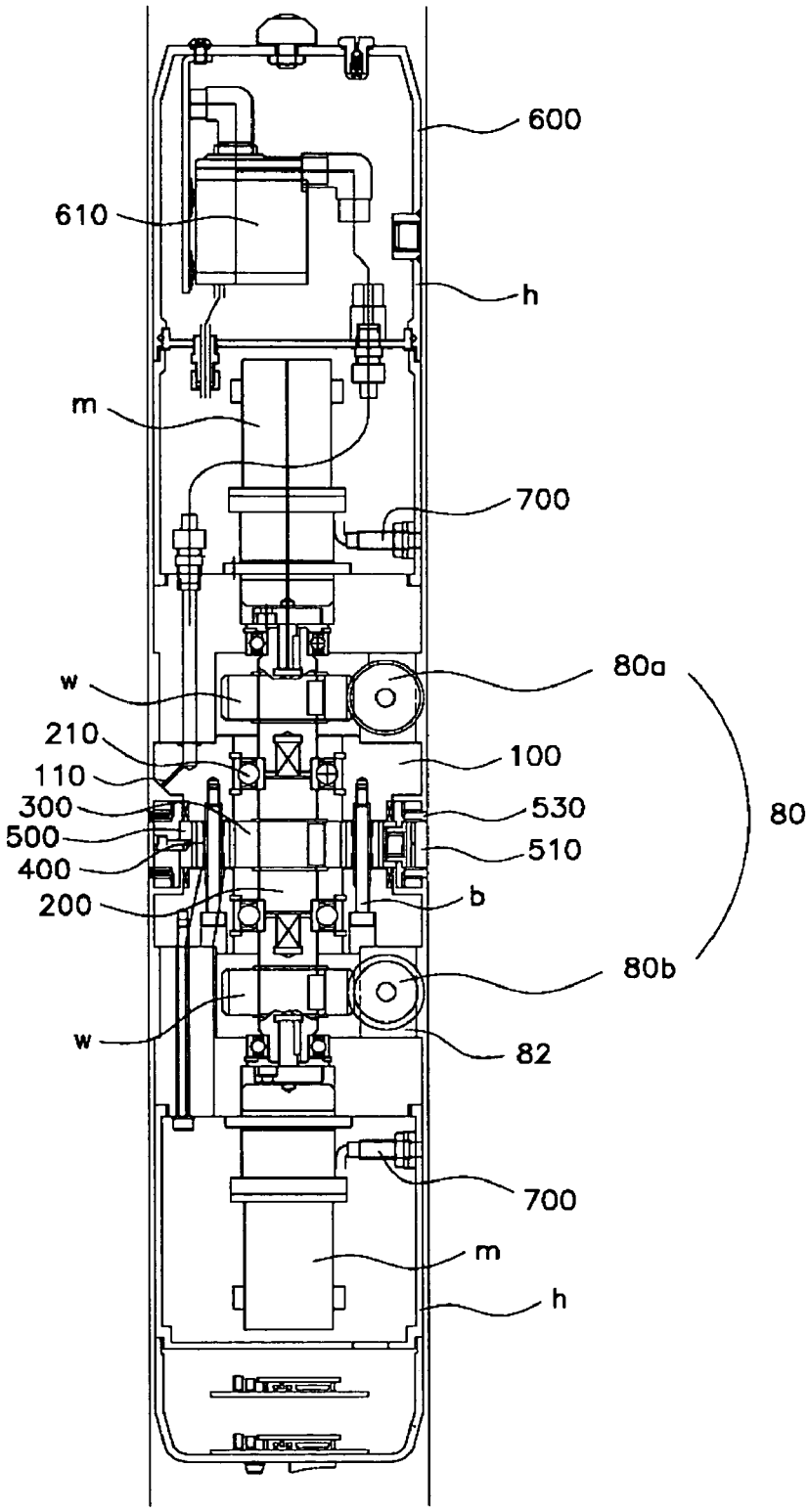
FIG. 2 is a cross-sectional view of an automatic cleaning apparatus for a gun barrel according to a preferred embodiment of the present invention.

FIG. 2 is a cross-sectional view of the automatic cleaning apparatus for gun barrel according to a preferred embodiment of the present invention, the automatic cleaning apparatus including two motors.

Motors m are built in a housing h, and are coupled to a reduction gear. The motors are positioned on the same axis. A worm gear w is coupled to a rotary shaft of each motor m, and the two worm gears are coupled to a main shaft 200. A plurality of wheels 80 are coupled to each worm gear w, and can be rolled by the rotation force transferred from the worm gear.

In this embodiment, a gear housing 100 is interposed between front wheels 80*a* and rear wheels 80*b*, and keeps its balance. Three front wheels 80*a* and three rear wheels 80*b* are spaced apart from each other at regular intervals, and are rotated with the worm gear w.

Figure 3:
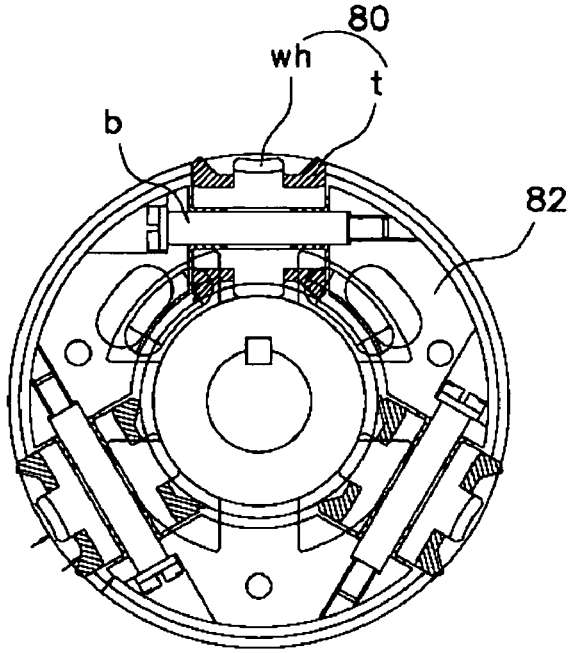
FIG. 3 is a cross-sectional view illustrating the mounting state of a worm gear.

FIG. 3 is a cross-sectional view illustrating the state in which the worm gear is mounted by a bracket 82. The bracket 82 is provided with three openings communicated with the worm gear w. Each wheel is positioned in and fixed to the opening by bolts b. The structure of installing the wheel may be altered in various ways, as described in the prior art.

Preferably, the part of the wheel which comes in contact with the inner surface of the gun barrel is provided with a tire t made of, for example, urethane. That is, each wheel has a worm wheel wh meshed with the worm gear w and the tire t. In particular, the wheel which is fixed to the bracket by the bolts can be rotated through a bushing in this embodiment, but the wheel is rotatably supported by a bearing, if necessary.

The front wheel 80*a* and the rear wheel 80*b* are operated by the two motors m in this embodiment, but can be operated by only one motor which is selected from the known motors.

A DC motor is utilized in this embodiment, but an AC motor can be used, if necessary. This selection is not deviated from the technical aspects of the present invention, and various changes or alterations can be achieved.

The gear housing 100 installed between the front wheel 80*a* and the real wheel 80*b* will now be described.

The gear housing 100 is provided with an opening penetrating an axial center part, and a through-hole (not shown) on a center part perpendicular to the axial direction, and a planetary gear 400 is installed in the through-hole. Also, the gear housing 100 is provided on the outer surface thereof with a groove for receiving an external gear which is meshed with the planetary gear 400.

The gear housing 100 has on left and right sides thereof a structure coupled to the bracket 82 and fixed to the housing h having a motor by using the bolts b. The axial center part of the gear housing 100 is drilled, and the main shaft 200 is disposed in the drilled hole of the axial center part. Preferably, the main shaft 200 and the gear housing 100 can be supported by a plurality of bearings 210, and a general ball bearing may be applied.

As shown in FIG. 2, it is preferable that a spray orifice 110 for dispensing the cleaning solution or anti-resistive oil is formed around the groove, in which the external gear is installed, formed on the outer surface of the gear housing 100. The dispensation of the cleaning solution or anti-resistive oil will be described hereinafter.

A sun gear 300 with teeth formed on the outer surface thereof is engaged and fixed to the outer surface of the main shaft 200 by a key, so that the sun gear 300 is rotated with the main shaft 200.

The planetary gear 400 is positioned in the through-hole of the gear housing 100, and is meshed with the sun gear 300. In this embodiment, there are four planetary gears 400 which are fixed to the gear housing 100 by bolts b.

The planetary gear 400 is meshed with the sun gear 300, and is not revolved around the sun gear, but rotated on its axis.

The external gear 500 meshed with the planetary gear 400 will be described. The external gear 500 is positioned in the groove formed on the outer surface of the gear housing 100, and the teeth formed on the inner surface are meshed with the planetary gear 400.

Figure 4:
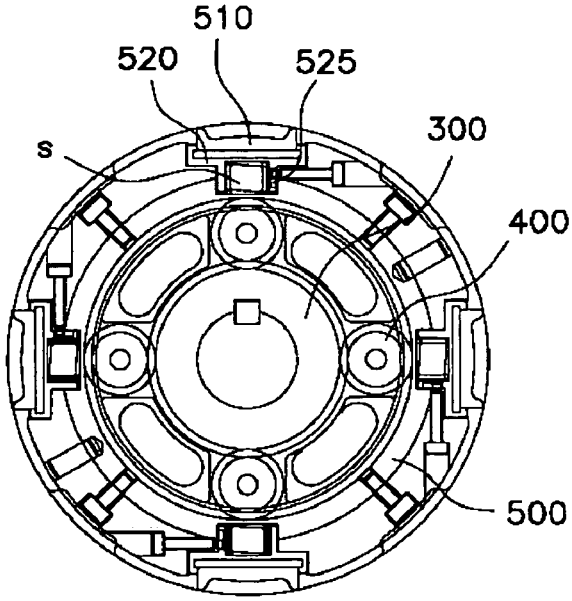
FIG. 4 is a cross-sectional view illustrating the state in which a brush is mounted on an external gear.

In particular, the brush 510 is attached to the outer surface of the external gear 500, and FIG. 4 is a cross-sectional view illustrating the state in which the brush is mounted on the external gear.

As described above, a non-woven fabric may be attached to the external gear, instead of the brush. Explaining the construction of the brush 510, the brush 510 is coupled to the outer part of the connector 520 to be coupled to the external gear 500, and the connector 520 is inserted into the external gear 500 and is restrained by the external gear 500. The connector 520 is inserted into the external gear, with a spring s being installed under the lower surface of the connector 520. The connector 520 is provided with a guide groove 525 on one side surface thereof, and the guide groove 525 is formed in a track shape.

An end part of the bolt is inserted into the guide groove 525, and thus the connector 520 can be moved up and down by a distance of the guide groove 525. The brush 510 is mounted on the upper surface of the connector 520. It is preferable that the brush 510 is formed in a cartridge type so that it can be easily attached to or detached from the connector.

Since the connector 520 is supported by the spring s, the connector 520 is moved upward to come in contact with the inner surface of the gun barrel, although the brush 510 is worn due to the repetitive use. As a result, even though the brush is worn due to long-term use, the brush 510 can be utilized as long as it comes in contact with the inner surface of the gun barrel.

The mounting of the brush on the external gear 500 is described in this embodiment, but a non-woven fabric can be selectively installed to the external gear when it is constructed in the same manner as the brush.

Further, a non-woven fabric 530 can be coupled to left and right sides of the brush 510.

The connection of the non-woven fabric to the brush is achieved by a nut. The brush 510 detaches rust or alien substance from the inner surface of the gun barrel, whereas the non-woven fabric applies evenly the cleaning solution onto the inner surface of the gun barrel or removes fine alien substance from the inner surface.

That is, either of the brush and the non-woven fabric can be installed to the external gear, if necessary, and both of them can be used at the same time.

The supply of the cleaning solution will now be described.

As shown in FIG. 2, an oil container 600 is coupled to one end part of the housing h equipped with the motor m. In this embodiment, the oil tank 600 has an attachable/detachable structure. Therefore, when the gun barrel is cleaned, the oil container is coupled to the housing to supply the cleaning solution. Another device can be coupled to the end part of the housing, instead of the oil container, which will be described hereinafter. The oil container 600 is directly coupled to the housing h equipped with the motor by a common fastening manner. That is, the oil container 600 is rotated and fixed to the housing, or is coupled to the housing by one touch manner.

The oil container 600 is filled with the cleaning solution or anti-corrosive oil, and has a pump 610 to discharge the cleaning solution or the anti-corrosive oil outwardly. When the pump 610 operates, the cleaning solution is moved along a conduit, and is finally dispensed through the spray orifice 110 formed on the gear housing 100. The spray orifice 110 formed on the gear housing 100 is sloped to dispense the cleaning solution or anti-corrosive oil onto the inner surface of the gun barrel. Preferably, the cleaning solution is dispensed ahead of the brush.

Although one oil container 600 is shown and described in this embodiment, the oil container 600 may be divided into tow parts which are filled with the cleaning solution and the anti-corrosive oil, respectively. The solutions stored in the oil containers 600 can be appropriately selected, if necessary.

If one of the oil containers 600 is filled with the cleaning solution and the other of the oil containers 600 is filled with the anti-corrosive oil, the cleaning solution and the anti-corrosive oil can be electively pumped out. In order to achieve it, the conduits of the oil containers 600 are closed/opened by using a solenoid valve connected to one oil pump 600 so as to supply the cleaning solution and anti-corrosive oil selectively.

In the present invention, the oil pump and the solenoid valve are widely known in the art, and they are not shown and described in detail. The construction thereof may be properly changed within the scope of the present invention.

Also, the automatic cleaning apparatus for gun barrel may be provided with a plurality of sensors 700. In this embodiment, one sensor is mounted on the front side of the front wheel 80*a* and the rear side of the rear wheel 80*b*. The sensors detect the wheels out of the muzzle of the gun barrel. When the sensor detects the wheel out of the muzzle, the motor is stopped.

The automatic cleaning apparatus includes a controller (not shown) to automatically control the operation of the motor and dispensing of the cleaning solution. The controller is widely known in the art, and the construction thereof will not be described herein.

A battery may be used as a power source for driving the motor, or the motor is fed with the power from the exterior through a cable connected to the motor. Preferably, the automatic cleaning apparatus is operated by the battery in field operation, and is operated by the external power source in an army post.

The automatic cleaning apparatus of the present invention can be used as a propulsion means movable forward along the inside of the gun barrel, with the oil container being removed. As one example, the automatic cleaning apparatus can be coupled to a dud removing device for removing a dud, instead of the oil container.

The dud removing device is to push out the dud from the gun barrel. It is necessary to use the propulsion means so as to push out the dud, and thus the present invention can be utilized. That is, the main object of the present invention is to the cleaning of the gun barrel, but the present invention can be utilized for other purposes (cleaning of pipeline). Therefore, the present invention is technology having high industrial application.

More preferably, the automatic cleaning apparatus is provided with a control panel on the outer surface thereof. Various conditions associated with the operation of the automatic cleaning apparatus can be inputted or changed through the control panel. That is, although not shown, the control panel can be connected to the controller to select the cleaning solution or the anti-corrosive oil to be dispensed. Also, a dispensing amount is determined, and the rolling speed of the wheel is adjusted to change the advancing speed of the automatic cleaning apparatus.

The operation of the automatic cleaning apparatus for gun barrel according to the present invention will now be described in brief.

The automatic cleaning apparatus coupled to the oil container is pushed into the muzzle of the gun barrel, and then the power is turned on. When the power is supplied to the apparatus, the motor is rotated, and thus the front wheels and the rear wheels roll, with the wheels being in contact with the inner surface of the gun barrel. Therefore, the automatic cleaning apparatus proceeds gradually, and, simultaneously, the oil pump is operated to dispense the cleaning solution or the anti-corrosive oil.

The sun gear engaged to the main shaft is rotated by the drive of the motor, and the planetary gear meshed with the sun gear is also rotated. Further, the external gear meshed with the planetary gear is rotated. Since the brush is mounted on the external gear, the cleaning of the inner surface of the gun barrel is achieved by the operation of the brush which comes in contact with the inner surface.

That is, the inner surface of the gun barrel is cleaned while the automatic cleaning apparatus moves forward. Further, the present invention can apply the anti-corrosive oil onto the inner surface of the gun barrel to prevent generation of the rust, as well as the cleaning.

In case where only the anti-corrosive oil is applied, the non-woven fabric is attached to the external gear so as to easily resist the rust, instead of the brush. Also, the automatic cleaning apparatus can perform the cleaning operation through repeated reciprocation in the gun barrel, since it is automatically controlled according to the conditions to be input.

As one example, the cleaning solution can be primarily dispensed onto the inner surface to clean the gun barrel, and subsequently, the anti-corrosive oil can be secondarily dispensed onto the inner surface to resist the rust.

The automatic cleaning apparatus of the present invention can be varied in various manners, since the operation condition is diversely set through the control panel. As describe above, the present invention employs the sun gear, the planetary gear, and the external gear by using the gear housing. Accordingly, the whole construction is simplified, and its operability is improved.

With the above description, since the automatic cleaning apparatus of the present invention employs the planetary gear system to operate the brush, the construction is compact and simple, as compared with the prior art. Thus, it can reduce the frequent failure, and its operability is good.

By dispensing the cleaning solution and the anti-corrosive oil through separate pumps, the motor is not loaded, and the construction of the motor is simplified, as compared with the prior art. Further, there is no mechanical connection for dispensing the cleaning solution and the anti-corrosive oil, driving the wheels, and the operating the brush. Therefore, the components associated with the above operations are not affected by each other, thereby minimizing the influence of the failure due to the failure of any component.

Further, since two motor is coupled to the main shaft to generate a larger force, the brush can be easily and smoothly operated, and it can prevent the overload of the motor.

The dimensions of the automatic cleaning apparatus can be varied, it can be applied to cannons of various calibers such as 65-caliber gun, 90-caliber gun, 105-caliber gun, 155-caliber gun, 8 inch gun, or the like. Gun crews can be effectively disposed, since the gun barrel of the cannon is quickly cleaned, which can increase the military power of an arms unit.

Further, the present invention is utilized to apply the anti-corrosive oil so as to prevent rusting of the inner surface of the gun barrel in normal, but it can be used as a propulsion means movable forward along the inside of the gun barrel, with the oil container being removed. Also, the present invention can be utilized to clean the pipeline to that a person hardly approaches.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An automatic cleaning apparatus for a gun barrel including a wheel contacting an inner surface of the gun barrel and a brush or non-woven fabric rotating against the inner surface of the gun barrel which is applied with a cleaning solution or anti-corrosive oil, and moving forward by rotation of the wheel, the automatic cleaning apparatus comprising:

a gear housing interposed between a front wheel and a rear wheel which are rotated in cooperation with a plurality of motors, and having a penetrated axial center part;

a main shaft installed in the center part of the gear housing, and coupled to the plurality of motors and rotated by the motors, wherein the motors are arranged in opposition to each other, and are coupled to the main shaft to transfer forces generated from the plurality of motors to the main shaft;

a sun gear disposed in a direction perpendicular to an axial direction of the gear housing, and coupled to the main shaft;

a plurality of planetary gears positioned in a through-hole formed on the gear housing, restrained by a fastening bolt to mesh with the sun gear to rotate on its axis; and an external gear meshed with outer surfaces of the planetary gears, the brush or non-woven fabric being detachably engaged to the external gear.

2. The automatic cleaning apparatus as claimed in claim 1, further comprising an oil container filled with the cleaning solution or anti-corrosive oil, in which an oil pump is provided on an inside or outside of the oil container.

3. The automatic cleaning apparatus as claimed in claim 2, wherein the oil container is detachably coupled to the housing equipped with the plurality of motors.

4. The automatic cleaning apparatus as claimed in claim 2, wherein the oil pump is constructed to pump either of the cleaning solution and the anti-corrosive oil by using a solenoid valve.

5. The automatic cleaning apparatus as claimed in claim 1, further comprising a plurality of sensors detecting the wheel to be out of a muzzle of the gun barrel.

6. The automatic cleaning apparatus as claimed in claim 1, wherein the housing has a spray orifice for dispensing the cleaning solution or anti-corrosive oil onto the inner surface of the gun barrel.

7. The automatic cleaning apparatus as claimed in claim 1, further comprising a control panel to change conditions such as selection of the cleaning solution or anti-corrosive oil to be dispensed, a dispensing amount, and a rolling speed of the wheel.

8. An automatic cleaning apparatus for a gun barrel including a wheel contacting an inner surface of the gun barrel and a brush or non-woven fabric rotating against the inner surface of the gun barrel which is applied with a cleaning solution or anti-corrosive oil, and moving forward by rotation of the wheel, the automatic cleaning apparatus comprising:

a gear housing interposed between a front wheel and a rear wheel which are rotated in cooperation with a motor, and having a penetrated axial center part;

a main shaft installed in the center part of the gear housing, and coupled to the motor and rotated by the motor;

a sun gear disposed in a direction perpendicular to an axial direction of the gear housing, and coupled to the main shaft;

a plurality of planetary gears positioned in a through-hole formed on the gear housing, restrained by a fastening bolt to mesh with the sun gear to rotate on its axis; and an external gear meshed with outer surfaces of the planetary gears, the brush or non-woven fabric being detachably engaged to the external gear, wherein the brush or non-woven fabric is in a connector coupled to the external gear.

9. The automatic cleaning apparatus as claimed in claim 8, wherein the connector has a spring under a lower surface of the connector inserted into the external gear, and a guide groove is formed on one side of the connector.

10. The automatic cleaning apparatus as claimed in claim 8, wherein an additional non-woven fabric is engaged to left and right sides of the brush.

* * * * *